US011547216B2

(12) United States Patent
Kotelmach

(10) Patent No.: US 11,547,216 B2
(45) Date of Patent: Jan. 10, 2023

(54) BED VENTILATORS AND METHODS OF USE

(71) Applicant: SLEEPWELL SOLUTIONS INC., Calgary (CA)

(72) Inventor: Christopher Kotelmach, Calgary (CA)

(73) Assignee: 102101718 SASKATCHEWAN LTD., Saskatoon (CA)

( * ) Notice: Subject to any disclaimer, the term of this patent is extended or adjusted under 35 U.S.C. 154(b) by 264 days.

(21) Appl. No.: 16/341,439

(22) PCT Filed: Oct. 11, 2017

(86) PCT No.: PCT/CA2017/051210

§ 371 (c)(1),
(2) Date: Apr. 11, 2019

(87) PCT Pub. No.: WO2018/068139

PCT Pub. Date: Apr. 19, 2018

(65) Prior Publication Data

US 2020/0037777 A1 Feb. 6, 2020

Related U.S. Application Data

(60) Provisional application No. 62/406,851, filed on Oct. 11, 2016.

(51) Int. Cl.

| | |
|---|---|
| ***A47C 27/04*** | (2006.01) |
| ***A47C 21/04*** | (2006.01) |
| ***F04D 29/28*** | (2006.01) |
| ***F04D 29/42*** | (2006.01) |
| ***F04D 29/62*** | (2006.01) |

(52) U.S. Cl.
CPC ..... *A47C 21/044* (2013.01); *F04D 29/281* (2013.01); *F04D 29/4226* (2013.01); *F04D 29/626* (2013.01)

(58) Field of Classification Search
CPC ..... A47C 21/044; A47C 21/04; F04D 29/626; F04D 29/281; F04D 29/4226; F04D 17/16
See application file for complete search history.

(56) References Cited

U.S. PATENT DOCUMENTS

| | | | | |
|---|---|---|---|---|
| 2,560,349 | A | 4/1951 | Inglis | |
| 3,230,556 | A | 1/1966 | Wiusor | |
| 3,444,922 | A | 5/1969 | Dingman | |
| 4,939,804 | A * | 7/1990 | Grant | A47C 21/044 5/423 |
| 5,730,120 | A | 3/1998 | Yonkers, Jr. | |
| 7,631,377 | B1 | 12/2009 | Standford | |
| 7,908,688 | B2 | 3/2011 | Tompkins | |
| 8,353,069 | B1 | 1/2013 | Miller | |
| 9,149,127 | B2 | 10/2015 | Manouchehri | |

(Continued)

OTHER PUBLICATIONS

Night Bliss, In-bed body cooling system, accessed Oct. 10, 2016, 3 pages, URL=http://www.nightbliss.com/landing-2.html, 3 pages.

(Continued)

*Primary Examiner* — Fredrick C Conley
(74) *Attorney, Agent, or Firm* — Robert A. Nissen

(57) ABSTRACT

An apparatus has a bed with bedding; an air mover; and an air outlet defined by the air mover to direct air into a sleep zone of the bed. A method includes operating an air mover to direct air into a sleep zone defined between a bed and bedding.

19 Claims, 9 Drawing Sheets

(56) References Cited

U.S. PATENT DOCUMENTS

| | | | | |
|---|---|---|---|---|
| 2003/0140418 | A1 | 7/2003 | Klamm | |
| 2004/0170497 | A1* | 9/2004 | Snyder | F01D 15/10 415/206 |
| 2006/0101577 | A1* | 5/2006 | Lussier | A47C 21/044 5/423 |
| 2010/0011502 | A1* | 1/2010 | Brykalski | A47C 21/04 5/423 |
| 2012/0210513 | A1 | 8/2012 | Chestakov | |
| 2014/0201910 | A1 | 7/2014 | Rand | |
| 2015/0121619 | A1* | 5/2015 | Aramli | A47C 21/048 5/423 |
| 2015/0121620 | A1* | 5/2015 | Aramli | A47C 21/044 5/423 |

OTHER PUBLICATIONS

BedJet, BedJet Climate Comfort System with Biorhythm Sleep Technology, accessed Aug. 10, 2016, 2 pages, URL=https://bedjet.com/products/bedjetv1climatecomfortsystemwithbiorhythmsleeptechnologyanysizebedsinglezone, 2 pages.

Bed Fan, Bed Fan Personal Cooling System, accessed on Aug. 10, 2016, 2 pages, URL=http://www.thegreenhead.com/2012/07/bed-fan-personal-cooling-system.php.

International Search Report issued on related application PCT/CA2017/051210, 5 pages.

International Search Report issued on corresponding PCT application No. PCT/CA2017/051210, 5 pages.

* cited by examiner

BED VENTILATORS AND METHODS OF USE

TECHNICAL FIELD

This document relates to bed ventilators and related methods of use.

BACKGROUND

Bed ventilators, also known as bed coolers, are known to use fans, flexible diverter tubes, and scoops that reach into a user's bed to circulate cooled, ambient, or heated air to the user while the user sleeps. Floor and mattress mounted bed ventilators are known.

SUMMARY

An apparatus is disclosed comprising: a bed with bedding; an air mover; and an air outlet defined by the air mover to direct air into a sleep zone of the bed.

A method is disclosed comprising operating an air mover to direct air into a sleep zone defined between a bed and bedding.

In various embodiments, there may be included any one or more of the following features: the air outlet is oriented to direct air into contact with bedding above the air mover to form a bedding air conduit into the sleep zone of the bed. The bedding air conduit extends up along a side of the bed. The air mover is mounted to a side of the bed above a floor surface. The air mover is mounted to the side of the bed via a bed mount that extends laterally between: adjacent stacked mattresses; or between a mattress and a bed frame. The bed mount comprises one or more of a horizontal cantilever plate or horizontal cantilever bar. The bed mount comprises a part that hooks onto an upstanding wall of the bed frame. The bed mount is one or more of: removably and reversibly connected to the air mover; and one of a plurality of interchangeable and distinct bed mounts. The bed mount is one or more of the plurality of interchangeable and distinct bed mounts, and each of the plurality of interchangeable and distinct bed mounts are structured to slide into engagement with a bed mount retainer on the air mover. The air mover further comprises a bedding support that props up bedding above the air mover. The bedding support comprises a column that extends upward from the air mover. The bedding support comprises plural columns and an overhead bar. The bedding support is movable between an extended position and a retracted position. The air mover is below a plane defined by a base of the sleep zone of the bed, and the bedding support and/or temperature sensors rises above the plane. The bedding support is structured to reversibly give away upon being contacted with a force above a predetermined threshold. The bedding support is biased toward the extended position to press upward against the bedding. One or more of a motion sensor and a temperature sensor mounted to the bedding support and/or mounted in the bed. A controller connected to send control signals to the air mover. One or more of a motion sensor and a temperature sensor, in which the controller is connected to send control signals to the air mover based on signals from the one or more of a motion sensor and a temperature sensor. A temperature sensor. A motion sensor. The controller is programmed to use signals from the motion sensor to: detect a sleeping mode where a user is within the sleep zone between the bedding and the bed; and detect a non-sleeping mode where a user is on the bedding and outside the sleep zone.

The controller is programmed to: when the sleeping mode is detected, maintain the air mover in, or initiate the air mover to enter, an operational mode; and when the non-sleeping mode is detected, maintain the air mover in, or initiate the air mover to enter, an off mode. A temperature sensor mounted to or forming part of the bedding. One or more of a sleep zone temperature sensor and an ambient air temperature sensor, in which the controlled is connected to send control signals to the air mover based on signals from the one or more of the sleep zone temperature sensor and the ambient air temperature sensor. The controller is programmed to operate the air mover in: a high flow mode where the bedding in the sleep zone is at least partially lifted by air flow from the air mover to fill the bed; and a low flow mode where the air flow from the air mover follows the contour of a user's body without substantially lifting the bedding from the bed in the sleep zone. A remote input terminal connected to wirelessly send control signals to one or both the controller and the air mover. The remote input terminal comprises a mobile phone with an application layer installed in a memory of the mobile phone, with the application layer configured to display an operational interface configured to send control signals to the controller. An exterior housing of the air mover comprises a bedding retainer. The bedding retainer comprises a bedding receiving slot. The exterior housing has a bedside wall, and an outer wall opposite the bedside wall, and the bedding receiving slot extends the lateral length of the outer wall and opens in an upward direction. An entrance of the bedding receiving slot is located above an air inlet defined by the air mover. The bedding receiving slot is defined between a bedding retainer panel and the outer wall. The bedding retainer panel has side arms that wrap at least partially around opposed sides of the exterior housing. The bedding retainer panel is connected to the exterior housing by one or more of a hinge, a magnet, a latch, and a magnet. The bedding retainer comprises a clip to secure the bedding against the air mover. The exterior housing has a first side wall and a second side wall between a bedside wall and an outer wall, and one or more of the first side wall, the second side wall, and the outer wall mounts a respective clip. The clip comprises an arm that pivots between an open position and a closed position. The bedding retainer comprises a textured gripping surface. The air mover comprises a centrifugal fan. The centrifugal fan has backward-curved blades or forward curved blades. The centrifugal fan is mounted such that an axis of fan rotation is perpendicular to a side, of the bed, that is against the air mover. An exterior housing of the air mover has a base surface, a top surface, a first side wall, a second side wall, a bedside wall, and an outer wall opposite the bedside wall, an air inlet of the air mover is defined on one or more of the outer wall, the first side wall, the second side wall, and the base surface, of the air mover, and the air outlet is located on the top surface of the air mover. The air inlet is defined on the base surface of the air mover. The air mover comprises one or more of a heater and an air sterilizer. Operating further comprises directing air into contact with bedding above the air mover to form a bedding air conduit into the sleep zone of the bed. Prior to operating, mounting the air mover to a side of the bed above a floor surface. Inserting a horizontal cantilever, which extends from the air mover, between adjacent stacked mattresses or between a mattress and a bed frame. Mounting comprises connecting a hook, which extends from the air mover, onto an upstanding wall of a bed frame. Prior to mounting: selecting a bed mount from a plurality of interchangeable and distinct bed mounts; and connecting the selected bed mount to a bed mount retainer on the air mover. Propping up bedding above the air mover using a bedding support extended above the air mover. The bedding support comprises plural columns and an overhead bar. Propping up further comprises extending the bedding support above a plane defined by a base surface of a sleep zone of the bed, in which the air mover is below the plane. The bedding support reversibly giving way under a user contact force above a predetermined threshold. Detecting whether a user is present in the sleep zone; and maintaining the air mover in, or initiating the air mover to enter, an operating mode as long as the user is detected in the sleep zone Maintaining the air mover in, or initiating the air mover to enter, an off mode when no user is detected in the sleep zone, or a user is only detected on the bedding outside the sleep zone. Detecting a temperature of a user present in the sleep zone using a temperature sensor; and maintaining the air mover in, or initiating the air mover to enter, an air-moving mode when the temperature of the user is above a predetermined threshold temperature. The temperature sensor is one or more of an infrared sensor, a thermistor, a thermocouple, or another temperature sensing device. Detecting an ambient air temperature outside the bed using an ambient air temperature sensor; and adjusting an air flow rate of the air mover based on the ambient air temperature. Selecting an operating mode from a plurality of operating modes that include: a high flow mode where the bedding in the sleep zone is lifted by air flow from the air mover to at least partially fill the bed; and a low flow mode where the air flow from the air mover follows the contour of a user's body without substantially lifting the bedding from the bed in the sleep zone. Controlling operation of the air mover based on user preferences. Controlling operation of the air mover using commands entered into a remote input terminal that is connected to send wireless control signals to the air mover. Retaining the bedding within a bedding retainer on an exterior housing of the air mover. Feeding the bedding into a bedding receiving slot defined by the exterior housing. Retaining comprises securing the bedding to the exterior housing using a clip or a plurality of clips. The air mover comprises a centrifugal fan. Using one or more sensors to monitor a characteristic of a user within the sleep zone, and one or more of adjusting operation of the air mover and logging data from the one or more sensors in a computer readable medium.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIGS. 8 and 9 illustrate different open positions for various side bedding sheet clips. FIG. 10 illustrates the side bedding sheet clips in the closed position.

DETAILED DESCRIPTION

Immaterial modifications may be made to the embodiments described here without departing from what is covered by the claims.

Figures 1, 2, 3, 4, 5:
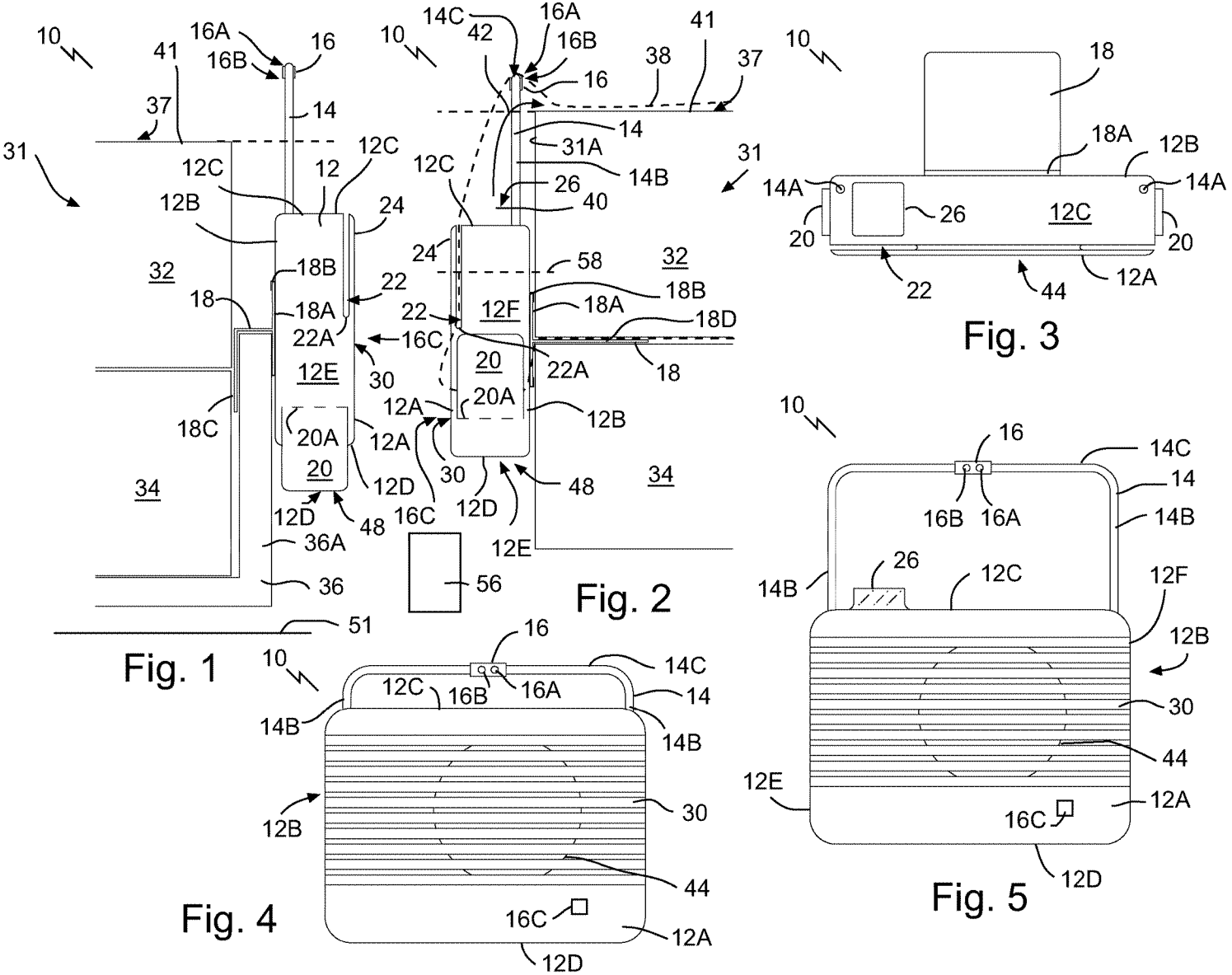
FIG. 1 is a side elevation view of an embodiment of a bed ventilator mounted to a vertical wall of a sleigh-style bed frame.
FIG. 2 is a side elevation view of another embodiment of a bed ventilator mounted to a side of a bed by insertion of a bed mounting plate in between a vertical stack of mattresses that make up the bed. The position of a bedding sheet is shown in dashed lines.
FIG. 3 is a top plan view of the bed ventilator of FIG. 2.
FIGS. 4 and 5 are front elevation views of the bed ventilator of FIG. 2, illustrating a bed support bar in a retracted and extended position, respectively, with motion and temperature sensors mounted to the bed support bar.
Figure 7:
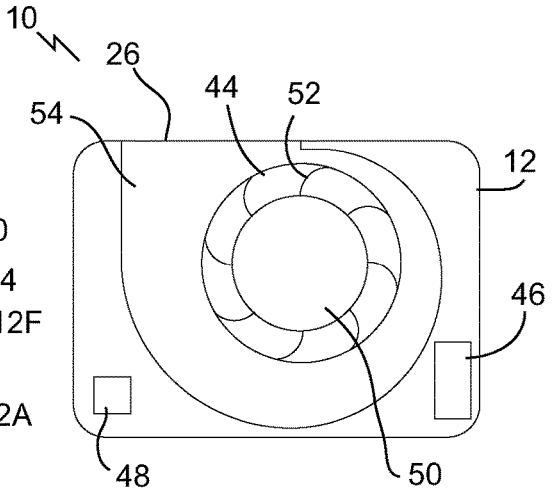
FIG. 7 is a section view of the bed ventilator of FIG. 2 illustrating the internal centrifugal fan with backward curved vanes.

Referring to FIGS. 1-2, a bed ventilator is disclosed. The bed ventilator may comprise an air mover 10 with an air outlet 26, which may or may not include a diverter. The ventilator or air mover 10 may be used with a bed 31 with bedding 38, such as a sheet and/or comforter. The air outlet 26 may be defined by the air mover 10 to direct air into a sleep zone 37 of the bed 31. In use the air mover may be operated to direct air into the sleep zone. A sleep zone may be a volume of space defined above a top sleeping surface 41 of a bed 31 below bedding 38. Referring to FIGS. 5 and 7, the air mover 10 may contain one or more of a microprocessor, such as a controller 48, a power source 46, such as a power converter, inverter, or other device adapted to convert A/C or D/C current from a wall outlet or battery into power to drive the operation of the air mover 10, a fan such as a centrifugal fan 44, a bedding support mechanism such as a bar or support 14, and a sensors such as a temperature sensor 16A and/or a motion sensor 16B. The support 14 and uprights or columns may form a U or C-shape. Referring to FIG. 1, the air mover 10 may be positioned above a floor surface 51 underlying the bed 31 so as to not interfere with any activities taking place on the floor, such as vacuuming or dusting. Positioning air mover 10 above the floor surface may minimize dust entering the air mover 10 through fan 44. The air mover 10 may draw air from the room and blow the air into the sleep zone 36 to maintain a comfortable sleeping temperature and/or to exhaust user heat buildup. The unit may contain sections for one or more other accessories such as aromatherapy oils, air filters, LED lights, noise cancelling devices, and diverters.

Referring to FIGS. 1 and 2, air mover 10 may mount to the bed 31 or bed frame 36. Air mover 10 may mount to a bed 31 by a suitable mechanism, such as a bed mount 18, for example a fixed clip or a removable clip. Air mover 10 may be mounted to a side of the bed 31 above the floor surface by a bed mount 18. Referring to FIG. 2, bed mount 18 may extend laterally between adjacent parts of the bed 31, for example stacked mattresses 32, 34 or between a mattress 34 and a bed frame 36. Bed mount 18 may comprise a horizontal cantilever plate 18D that extends between the adjacent parts of the bed 31 such as top mattress 32 and bottom mattress 34. In use, a user may mount air mover 10 to the bed 31 by inserting the horizontal cantilever plate 18D between adjacent stacked mattresses 32, 34 or between a mattress 34 and a bed frame 36. The plate 18D may be replaced by other forms of parts that achieve the same function, such as posts (bars), or a plurality of parts or plates. Air mover 10 may be mounted to the bed before operation. During use the weight of the mattress 34 or 36 may support the air mover 10 and maintain the air mover 10 in an upright position. In some cases bed mount 18 comprises a part, such as hook 18C that hooks onto an upstanding wall 36A of the bed frame 36. In use, mounting air mover 10 may comprise connecting hook 18C onto the upstanding wall of bed frame 36. Hook 18C may be a suitable mechanism for securing air mover 10 to the bed frame 36, for example a clip or sleeve. Bed mount 18 may connect to the air mover 10 via a mounting flange 18A for mounting the bed mount 18. In some cases, bed mount 18 is permanently mounted on housing 12, for example if mount 18 forms an integral part of housing 12 or is secured in a fashion that would cause damage upon separation.

Referring to FIGS. 1 and 2, bed mount 18 may be reversibly and removably connected to air mover 10. Bed mount 18 may permit air mover 10 to exhibit a reduced profile and be used horizontally relative to sleep zone 37. Bed mount 18 may be one of a plurality of interchangeable and distinct bed mounts 18. Prior to mounting the air mover 10 to the bed 31, a user may select a bed mount 18 from the plurality of interchangeable and distinct bed mounts and connect the bed mount 18 to a bed mount retainer 18B on the air mover 10. Each of the plurality of interchangeable and distinct bed mounts 18 may be structured to slide into engagement with a bed mount retainer 18B on the air mover 10, or to connect in a suitable fashion using a universal mounting system. Each bed mount 18 type may be designed for a different style of bed, for example a sleigh type bed (FIG. 1), or a traditional bed where sufficient room is present adjacent mattresses 32, 34 to mount the air mover 10. Bed mount retainer 18B may be secured to a bedside wall 12B of the housing 12.

Referring to FIG. 2, air outlet 26 may be oriented to direct air into the sleep zone 37 of the bed 31, for example in a direction 42. Air mover 10 may contact bedding 38 above the air mover 10 to form, in some cases to independently lift the bedding to form, a bedding air conduit 40 into sleep zone 37. Bedding conduit 40 may provide an efficient path of air movement to sleep zone 37. Bedding air conduit 40 may extend up along a side of the bed 31. In use, air mover 10 may be operated to direct air into contact with bedding 38 above the air mover to form a bedding air conduit 40 into the sleep zone 37.

Referring to FIG. 2, air mover 10 may comprise a bedding support 14 that props bedding 38 up above the air mover 10. The support 14 may provide support for heavier bedding 38 and/or to maintain an air flow conduit 40. In some cases no bedding support 14 may be used, for example if the power of the air mover 10 is sufficient to raise the bedding to create a bedding air conduit into the sleep zone. Bedding support 14 may comprise a post or column 14B that extends upward from the air mover 10. In use, the bedding 38 may be propped up above the air mover 10 by support bar 16 before or during operation of air mover 10. Referring to FIGS. 2, 4, and 5, bedding support 14 may comprise plural columns 14B and an overhead support 14C to provide conduit 40 and increase air flow to sleep zone 37. Referring to FIG. 2, air mover 10 may be positioned below a plane defined by a base surface 41 of the sleep zone 37 of the bed 31, and the bedding support 14 may be positioned to prop up bedding 38, for example by rising support 14 above the plane.

Figure 6:
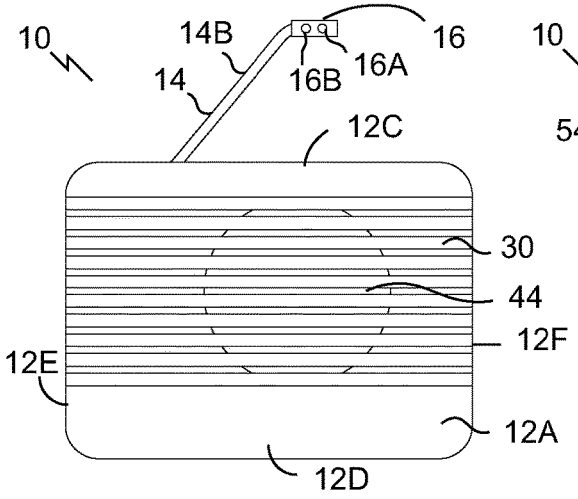
FIG. 6 is a front elevation view of another embodiment of a bed ventilator with a pivotally mounted column with a motion and temperature sensor.

Referring to FIGS. 4-6, bedding support 14 may be movable between a retracted position, for example position of support 14 in FIG. 4, and an extended position, for example the position of support 14 in FIG. 5. The support 14 may be set at different heights to accommodate for varying mattress thicknesses. Bedding support 14 may be structured to reversibly give away, for example collapse, bend, pivot, or retract, upon being contacted with a force above a predetermined threshold, for example, a contact force inadvertently exerted by a foot of a user. Bedding support 14 may reversibly transition between the extended position and the retracted position. Support 14 may allow for excess weight, such as a person sitting down, by collapsing temporarily to avoid damage to the unit or injury to the user. In some cases the bedding support 14 is biased toward the extended position to press upward against the bedding—a suitable biasing mechanism may be used such as a spring or bungee tether. Support 14 may mount one or more sensors 16A, 16B, such as one or more of a motion sensor and a temperature sensor. Sensors 16A and 16B may be configured to provide no or minimal interference with the sleeping user. Referring to FIG. 3, support bar 16 may be removable and may be inserted into apertures 14A defined by wall of the housing, such as a top wall or surface 12C.

Referring to FIGS. 4 and 7, a controller 48 may be connected to send control signals to the air mover 10 to control operation of the air mover 10. Controller 48 may be connected to adjust the speed or power of components of the air mover 10, such as fan 44. Controller 48 may be connected to receive input from one or more sensors 16A, such as sensors 16A, 16B mounted on sensor housing or support bar 16. Sensor housing or support bar 16 may be mounted on support 14 or may be provided on a separate structure, or may be wireless or wired sensors placed in proximity or within the bed. A user temperature sensor, such as infrared temperature sensor 16A, may be connected to the controller 48 and the controller 48 may send control signals based on input signals, such as infrared radiation, from sensor 16A. The temperature sensor may effectively sense the temperature of the body or bodies of a user(s). For example, controller 48 may receive signals from temperature sensor 16A indicating that the body temperature is too high and controller 48 may respond by sending control signals to increase or reduce the air flow to sleep zone 37. Sensor 16A may detect a temperature of a user present in the sleep zone 37 and send signals to controller 48 to maintain the air mover 10 in, or initiate the air mover 10 to enter, an operational mode. In some cases, the controller 48 maintains the operational mode, or initiates the air mover 10 to enter the operational mode, as long as the temperature of the user is above a predetermined threshold temperature. In a heating application, where hot air is pumped into the bed, the logic may be reversed. Temperature sensor 16A may be a plurality of sensors that monitors one or more objects. Temperature sensor 16A or an additional sensor may monitor ambient temperature or the temperature of the bedding 38 or bed 31.

Referring to FIGS. 2, 4 and 5, air mover 10 may comprising a motion sensor 16B for measuring occupancy or activity of sleep zone 37. Controller 48 may be programmed to interpret and operate air mover 10 on the basis of signals from the motion sensor 16B. Controller 48 may detect a sleeping mode where, for example, a user is within the sleep zone 37 between the bedding 38 and the bed 31. While air mover 10 is in the sleeping mode, controller 48 may maintain the air mover 10 in, or initiate the air mover 10 to enter, an operational mode, where air flow is maintained into the bed. Motion sensor 16B may detect a non-sleeping mode, which may be where a user is on the bedding 38 and outside the sleep zone or the user is off the bed entirely, and send signals to controller 48.

During the operational mode, the air mover 10 may or may not pump air into the bed, depending on whether other conditions are satisfied. While in the non-sleeping mode the controller may maintain, or initiate the air mover 10 to enter, air mover 10 in an off mode. During the off mode the air mover 10 does not pump air into the bed, and the controller may enter a low or zero power state. In use, a typical sleeping mode sequence may be: detecting whether a user is present in the sleep zone 37 using a motion sensor 16B, sending signals to the controller 48, and the controller 48 initiates the air mover 10 to enter an operational mode as long as the user is detected in the sleep zone 37. The non-sleeping mode may be activated if the user leaves the sleep zone 37, and motion sensor 16B sends signals to the controller 48 to turn the air mover 10 in the off mode. The controller 48 may maintain the air mover in, or initiate the air mover 10 to enter, the off mode when no user is detected in the sleep zone, or a user is detected on the bedding outside the sleep zone. In some cases, the non-sleeping or sleeping mode may be activated by an absence of signal from motion sensor 16B. Other sensors may be used instead of or in addition to a motion sensor.

Referring to FIG. 4, air mover 10 may comprise an ambient air temperature sensor, such as sensor 16C. Sensor 16C may be connected to controller 48, which may send control signals to the air mover 10 based on signals from the ambient air temperature sensor 16C. Sensor 16C may be configured to detect an ambient air temperature outside the bed 31. Sensor 16C may then send signals to air mover 10, or to a component such as controller 48, to adjust the air flow rate based on the ambient air temperature. For example, sensor 16C may read an ambient temperature above a desired threshold, such as 23° C., and signal the controller 48 to increase the air flow to sleep zone 37 as more air flow may be needed to achieve a cooling effect as opposed to a situation where the ambient air is cooler and need not be blasted into the bed. Controller 48 may be programmed to operate the air mover 10 in a plurality of operating or on modes, such as a high flow mode or low flow mode. In an on mode the air mover 10 is pumping air. In some cases, the high flow mode is where the bedding 38 is lifted by air flow from the air mover 10 to fill the bed 31. The low flow mode may be where the air flow from the air mover 10 follows the contour of a user's body without substantially lifting the bedding 38 from the bed 31. The controller 48 may select one of a plurality of operating modes based on signals from one or more of sensors 16A-C and/or input from the user. Controller 48 may select an operating mode after receiving signals from a sensor that determines the weight of the bedding, such as a pressure sensor (not pictured), or through a bedding weight calibration process. Input from any one or more of sensors 16A-C may determine when to actuate fan 44 and at what speed to actuate fan 44.

Referring to FIG. 2, air mover 10 may comprise a remote input terminal 56 connected to wirelessly, for example through Wi-Fi or the internet, send control signals to one or both of the controller 48 and the air mover 10. An example of a remote input terminal is a smartphone or computer. Other wireless protocols may be used, such as ZigBee or BLE (Bluetooth Low Energy). In some cases a cellphone network may be used, for example a 3G or 4G network. A radio network may be used. A wired connection may also be used. Other wired or wireless control devices may be used, such as an IR scanner. Remote input terminal 56 may be configured to modify settings, modes, and parameters of the air mover 10. Terminal 56 may be configured to save the settings and parameters in the form of user profiles. Air mover 10 may collect and log data of a user in the sleep zone 37 from one or more sensors 16A, for example motion tracking, temperature of the user, ambient temperature, sleep cycles, rapid eye movement (REM) cycles, and other cycles. Air mover 10 may store data in a computer readable medium, such as on the remote input terminal 56. Remote input terminal 56 may include computer software, such as an application layer, that can be read on appropriate devices, such as a smartphone application for mobile phones or an online database. In some cases, remote input terminal 56 is mounted on air mover 10 and may be directly wired to the controller 48 and/or the air mover 10.

Referring to FIGS. 1-3 and 10, air mover 10 may comprise a bedding retainer for holding the bedding 38 against air mover 10. Bedding retainer may be defined or mounted by the housing 12. Bedding retainer may comprise a bedding receiving slot. In some cases, the bedding receiving slot 22 is located above an air inlet 30 defined by the air mover 10. Bedding receiving slot 22 may be defined by the housing 12, for example by a space between housing 12 and front panel 24 (FIG. 2). Housing 12 may have a bedside wall 12B, and an outer wall 12A opposite the bedside wall 12B, and the slot 22 may extend the lateral length of the outer wall 12A and open in an upward direction. In use, bedding 38, for example a terminal edge of same, may be fed into the retainer to retain the bedding 38 on the exterior housing 12 without restricting air flow into air intake or inlet 30. The bedding retainer may maintain the correct positioning of bedding 38 and permit sufficient air flow to support the air conduit 40.

Figure 8:
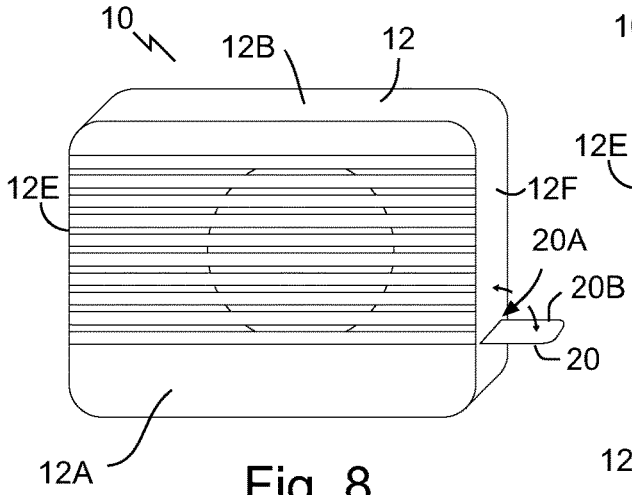
FIGS. 8, 9, and 10 are front perspective views of a bed ventilator.
Figure 9:
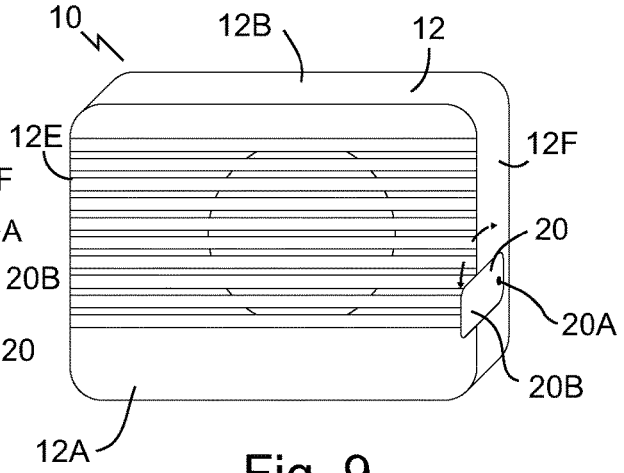
Figure 10:
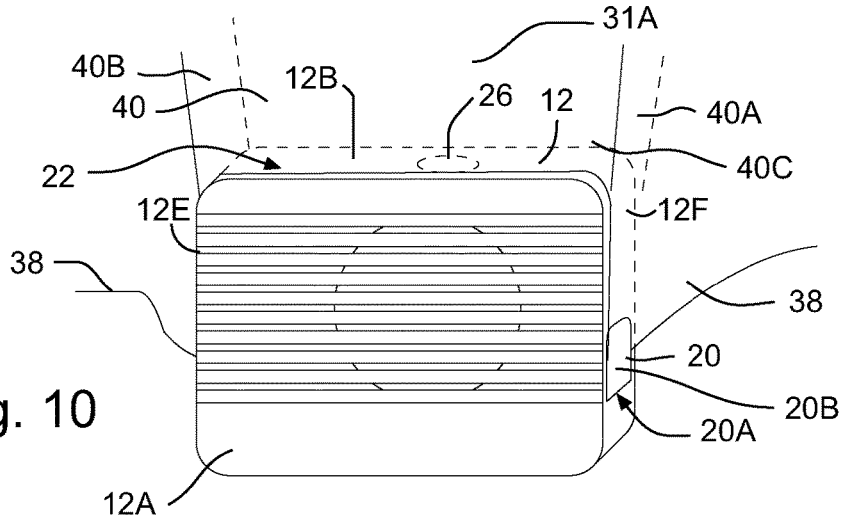
Figure 11:
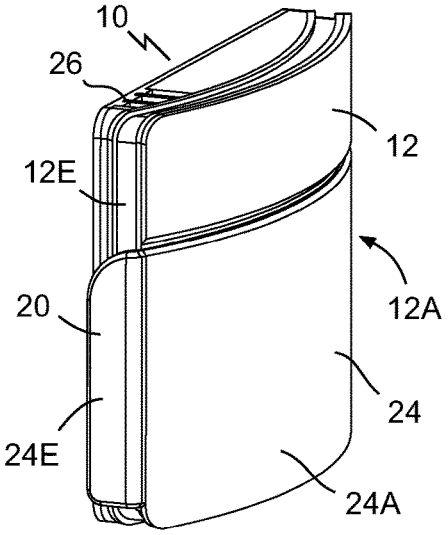
FIG. 11 is a top perspective view of another embodiment of a bed ventilator.
Figure 12:
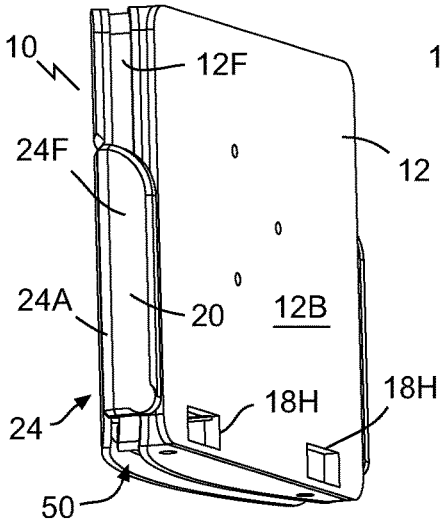
FIG. 12 is a bottom perspective view of the bed ventilator of FIG. 11.

Referring to FIGS. 8-10, air mover 10 may comprise a clip 20 to secure the bedding 38 against the air mover 10. In some cases the clip 20 is a plurality of clips mounted on side walls 12E, 12F of the housing 12 between the walls 12A and 12B. Plurality of clips 20 may retain the bedding 38 by securing the bedding 38 to side walls 12E, 12F of the exterior housing 12. Plurality of clips 20 may comprise an arm 20B that pivots by a suitable mechanism such as pivot pin 20A. Arm 20B may pivot between an open position, in which bedding 38 may be placed between the arm 20B and the housing 12, and a closed position, in which bedding 38 is retained between the housing 12 and the arm 20B. Bedding 38, such as sheets, may be held in place by clip 20 and the bedding retainer to provide the air conduit 40, which may prevent air from leaking, improve the efficiency and allow for a quieter operation of the fan. The bedding retainer may hold the bedding sufficient to form a closed air conduit 40, for example defined by side 31A of the bed, and walls 40A-C of the bedding. The retainer may hold the walls 40A and B against the side 31A of the bed to effectively seal the conduit 40. Placing adjacent parts of the bedding underneath mattress 32 may assist in forming the sealed conduit. A sealed conduit may function more efficiently than a loose or leaky conduit. Clips 20 may be fixed or hinged. Clips 20 may be removable. The gap width between the housing 12 and the clip 20, and/or the slot 22 may be variable, to adjust for different thicknesses of beddings. A lock (not shown) may be used for either or both clips 20 and slot 22, for example to lock the clip and/or slot 22 in place to secure the bedding.

Referring to FIG. 7, air mover 10 may comprise a centrifugal fan 44 for moving air through the air mover 10. Fan 44 may move the air from air inlet 30 to air outlet 26 by intaking air via a centrifugal effect created by impeller intake 50 and fan blades 52. Blades 52 may be backward-curved blades 52 and provide an enhanced centrifugal effect and air flow directionality. Forward-curved blades may be used, or other styles of blades or vanes. The air may be expelled through volute 54 into air outlet 26 and conduit 40. Referring to FIG. 2, fan 44 may be mounted such that an axis of fan rotation 58 is perpendicular to a side of the bed 31, such as side 31A, that is closest to the air mover 10. Such a configuration provides one direction change to air passing through the air mover 10, which provides improved efficiency and power relative to a system that incorporates two or more direction changes. In some cases, fan 44 is a positive displacement fan. Air inlet 30 may be defined on the outer wall 12A of the air mover, and the air outlet may be located or defined on the top surface 12C of the air mover. Air outlet 26 may comprise a removable or fixed diverter to assist with directing airflow in a desired direction.

Figure 15:
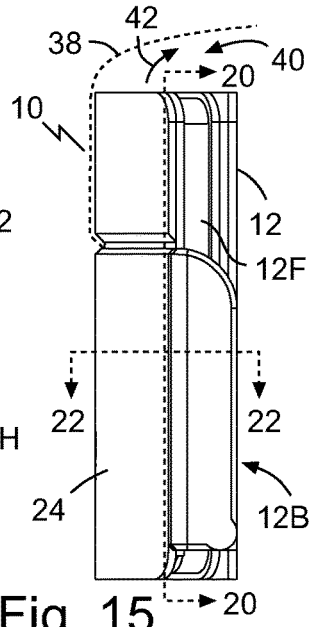
FIG. 15 is a side elevation view of the bed ventilator of FIG. 11.
Figure 13:
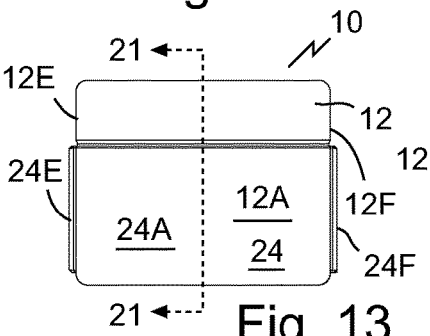
FIG. 13 is a front elevation view of the bed ventilator of FIG. 11.
Figure 14:
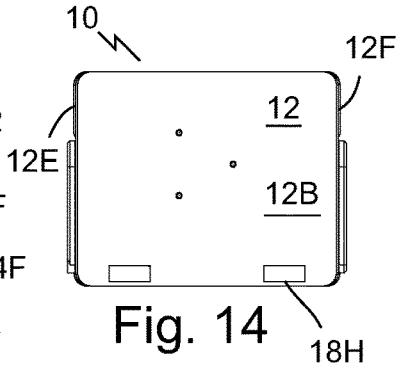
FIG. 14 is a rear elevation view of the bed ventilator of FIG. 11.
Figure 16:
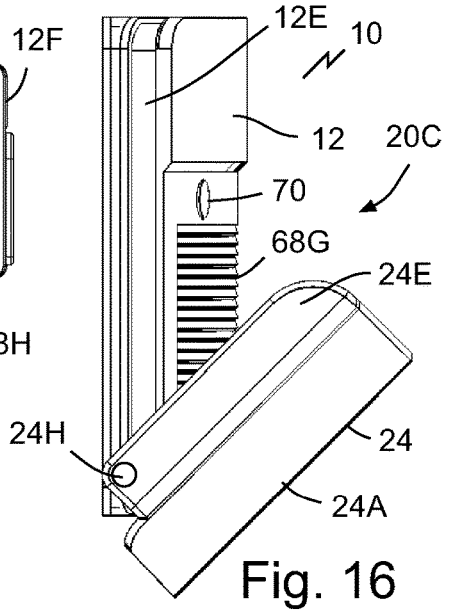
FIG. 16 is a side elevation view of another embodiment of the bed ventilator of FIG. 11 illustrating an air inlet cover rotated about a hinge into an open, bedding receiving position.
Figure 17:
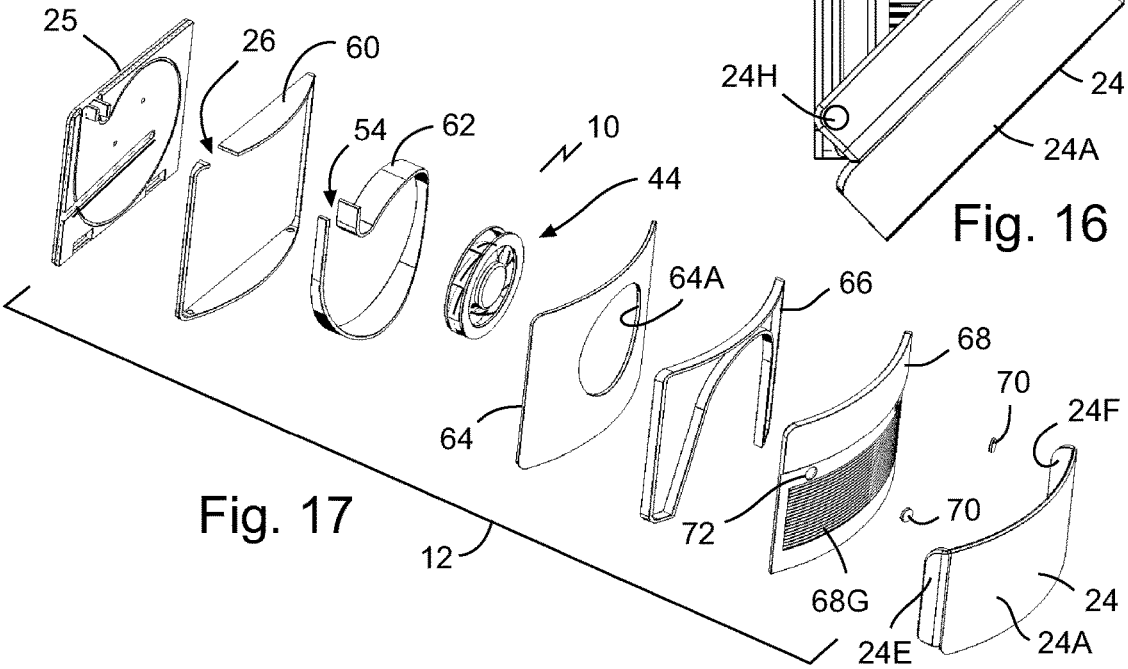
FIG. 17 is an exploded perspective view the bed ventilator of FIG. 11.
Figure 18:
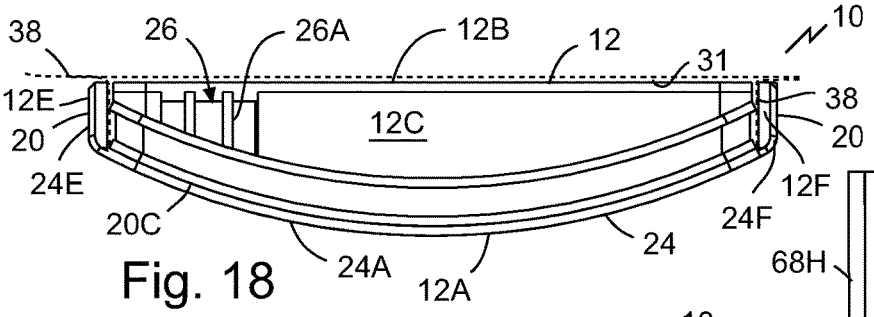
FIG. 18 is a top plan view the bed ventilator of FIG. 11.
Figure 19:
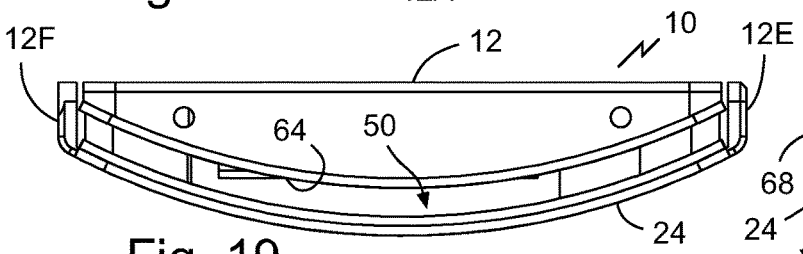
FIG. 19 is a bottom plan view the bed ventilator of FIG. 11.
Figure 20:
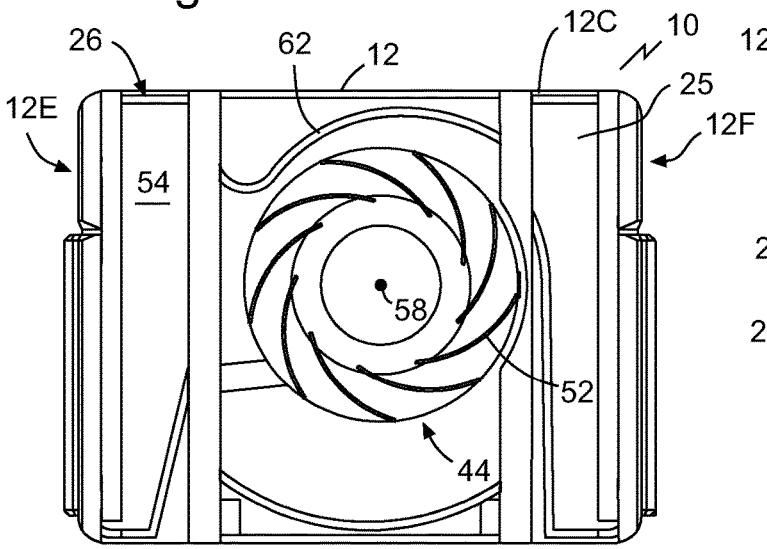
FIG. 20 is a section view taken along the 20-20 section lines from FIG. 15.
Figure 21:
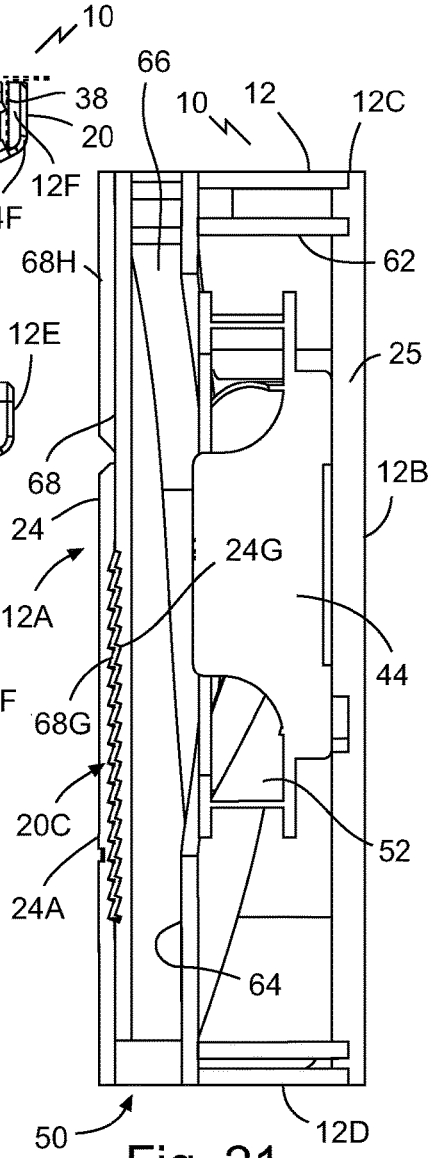
FIG. 21 is a section view taken along the 21-21 section lines from FIG. 13.
Figure 22:
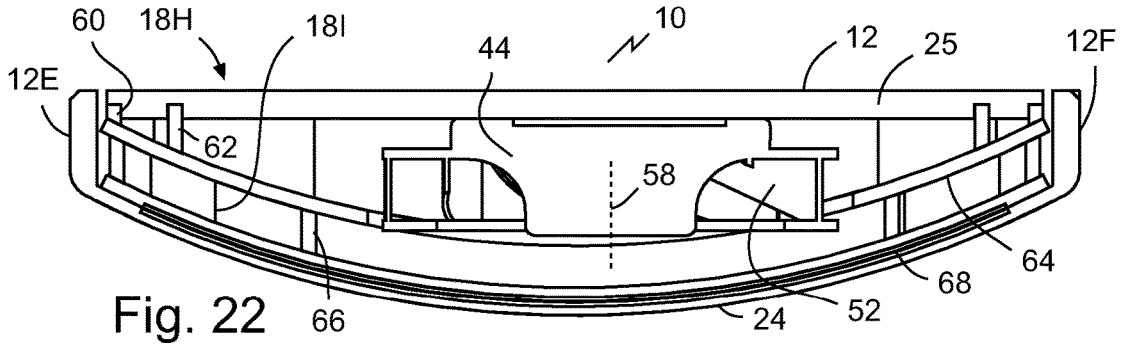
FIG. 22 is a section view taken along the 22-22 section lines from FIG. 15.

Referring to FIGS. 11-40, further embodiments of a bed ventilator are illustrated. Referring to FIGS. 16-17, two versions of a bed ventilator are illustrated with various mechanisms for retaining bedding. Referring to FIG. 17, the ventilator may comprise one or more of a rear plate or panel 25, a housing perimeter wall 60, a volute wall 62, a volute front panel 64, a fan intake guide wall 66, an exterior panel 68, and a front panel 24. The front panel 24 may cooperate with the housing 12 to form a bedding retainer. For example, as shown in FIGS. 15, 17 and 21 the panel 24 may connect within a recessed portion 68I of panel 68, to grip a sheet or bedding 38 against the outer wall 12A. The recessed portion 68I may cooperate with an extended part 68H, in order to ensure that the bedding 38 contacts and is put under tension against the housing 12 in use. The panel 24 may have a front part 24A, which connects, for example wraps as shown into side walls 24E, F, which cooperate to retain the bedding 38 against the outer wall 12A and side walls 12E, F of the housing 12. Referring to FIG. 21, one or more gripping surfaces, for example alligator teeth or high friction surfaces 68G and 24G may be present to grip the bedding 38 against removal. Referring to FIG. 16, a magnet 70, for example positioned within an aperture 72 may secure the panel 24 in place, for example via cooperating metal or magnet parts on panel 24. In the example shown in FIG. 17, the panel 24 is removable. Referring to FIG. 16, a variation is shown where the panel 24 may be rotated between an open position and a bedding retaining closed position about a hinge 24H. Other variations may be used, such as a latch, or other suitable locking system.

Figure 23:
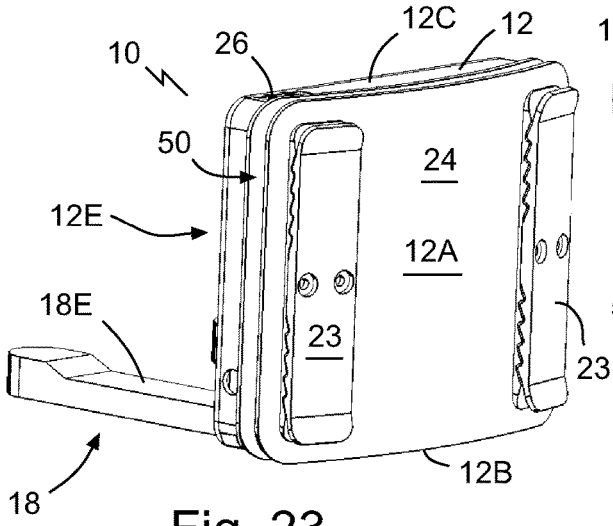
FIG. 23 is a top perspective view of another embodiment of a bed ventilator.
Figure 24:
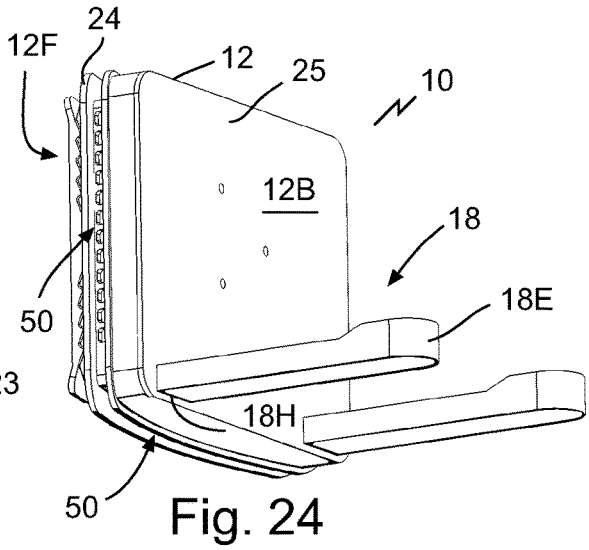
FIG. 24 is a bottom perspective view of the bed ventilator of FIG. 23.
Figure 25:
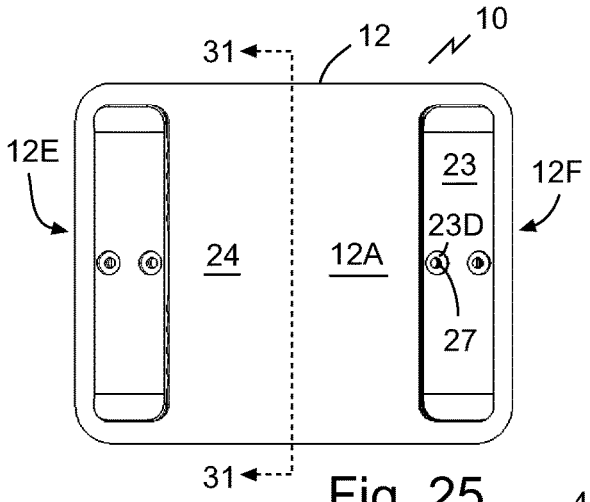
FIG. 25 is front elevation view of the bed ventilator of FIG. 23.
Figure 26:
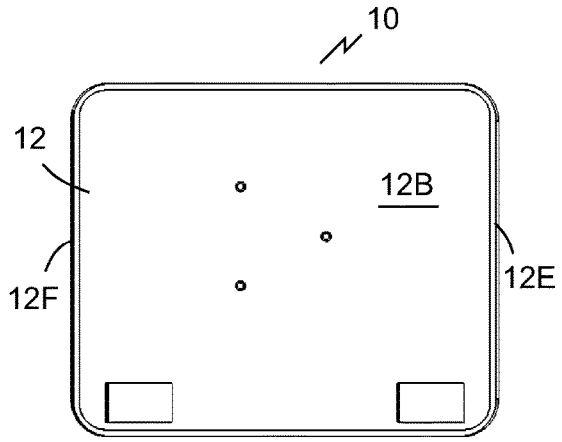
FIG. 26 is a rear elevation view of the bed ventilator of FIG. 23.
Figure 27:
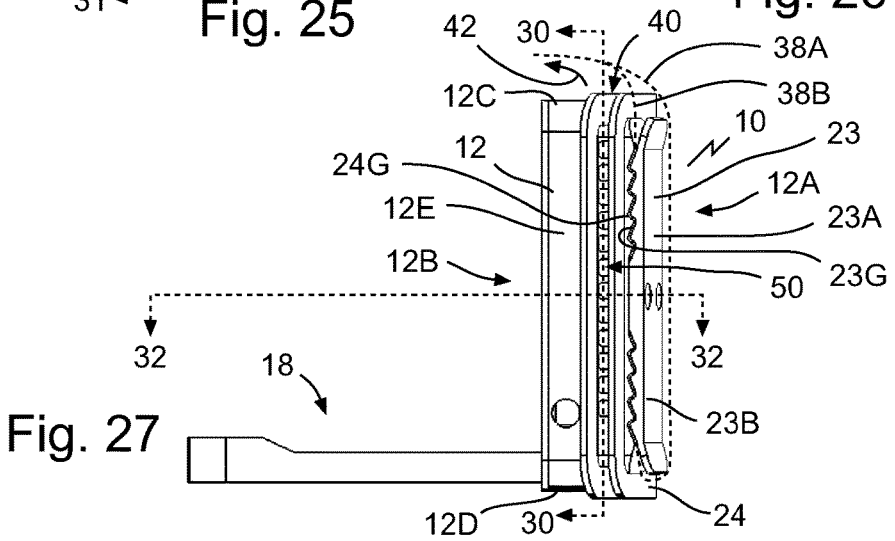
FIG. 27 is a side elevation view of the bed ventilator of FIG. 23.
Figure 28:
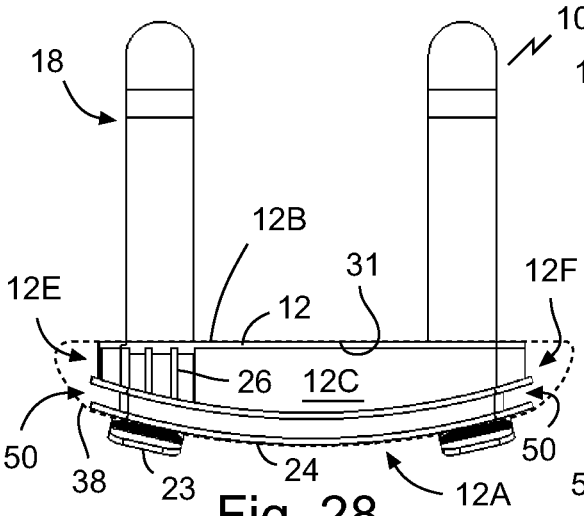
FIG. 28 is a top plan view the bed ventilator of FIG. 23.
Figure 29:
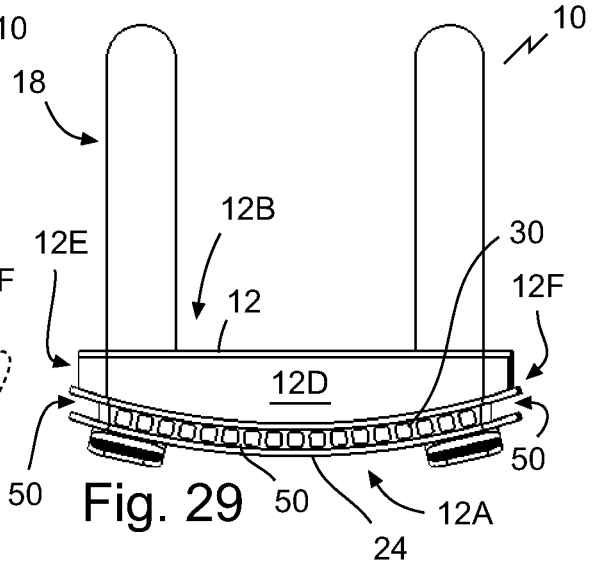
FIG. 29 is a bottom plan view the bed ventilator of FIG. 23.
Figure 30:
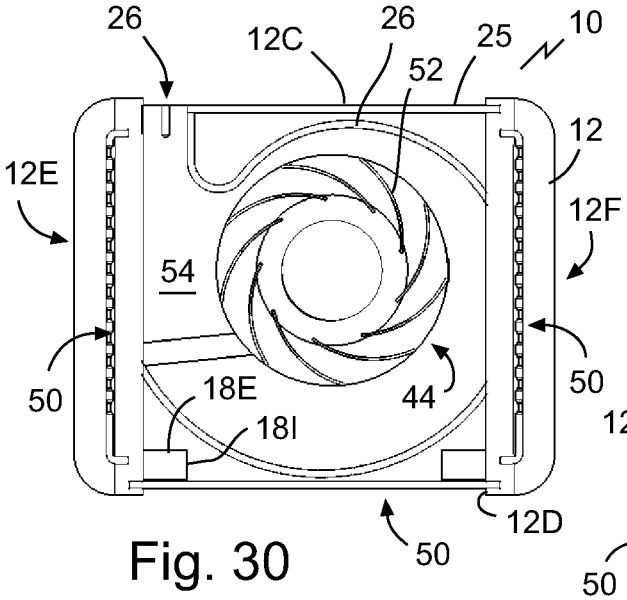
FIG. 30 is a section view taken along the 30-30 sections lines from FIG. 27.
Figure 31:
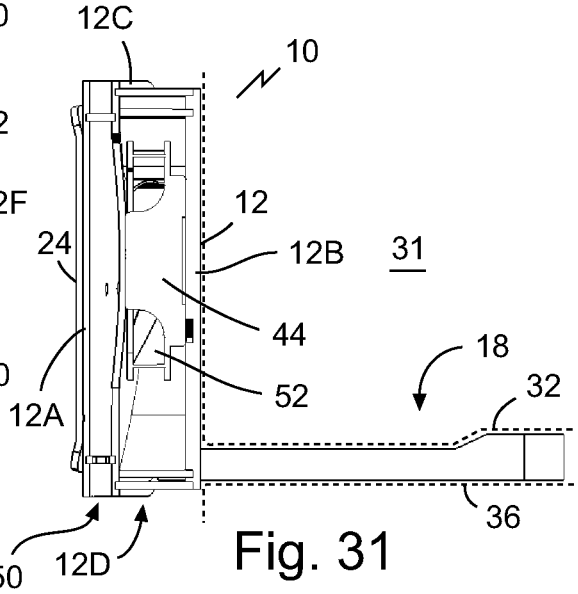
FIG. 31 is a section view taken along the 31-31 section lines from FIG. 25.
Figure 32:
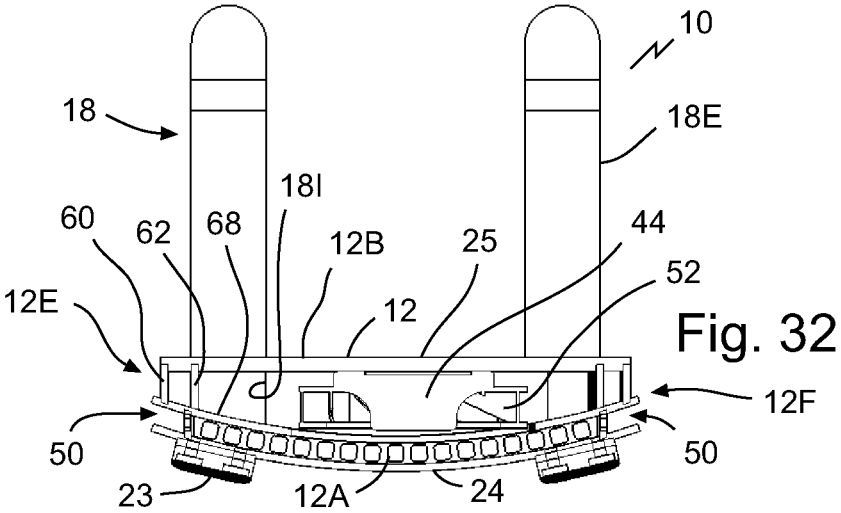
FIG. 32 is a section view taken along the 32-32 section lines from FIG. 27.
Figure 33:
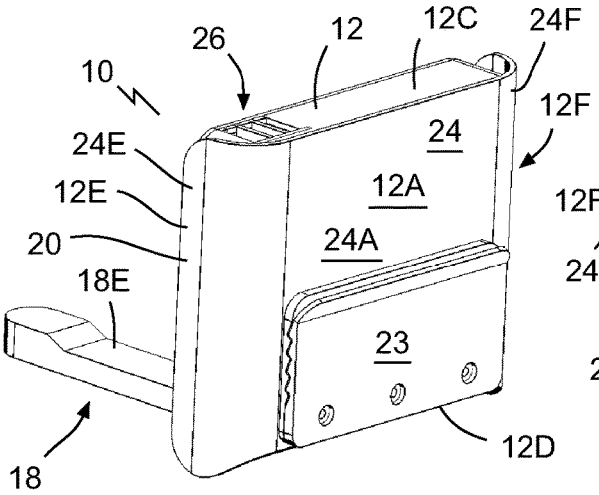
FIG. 33 is a top perspective view of another embodiment of a bed ventilator.
Figure 34:
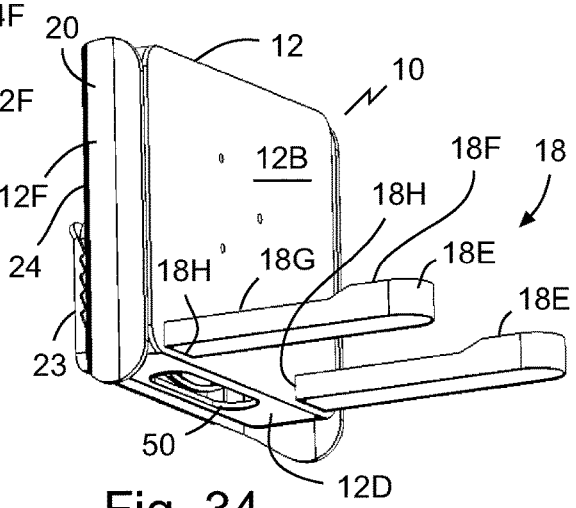
FIG. 34 is a bottom perspective view of the bed ventilator of FIG. 33.
Figure 35:
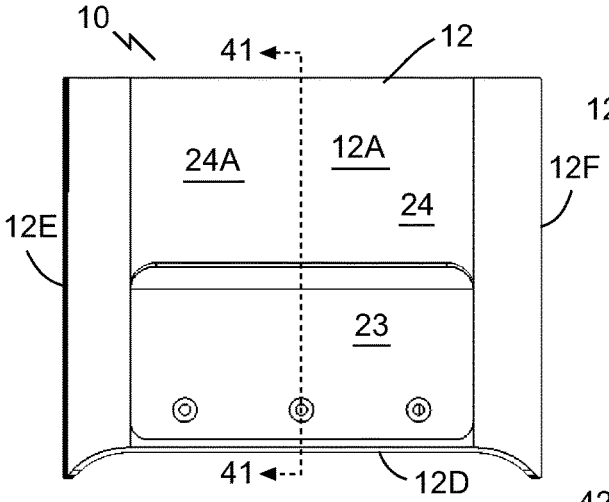
FIG. 35 is front elevation view of the bed ventilator of FIG. 33.
Figure 36:
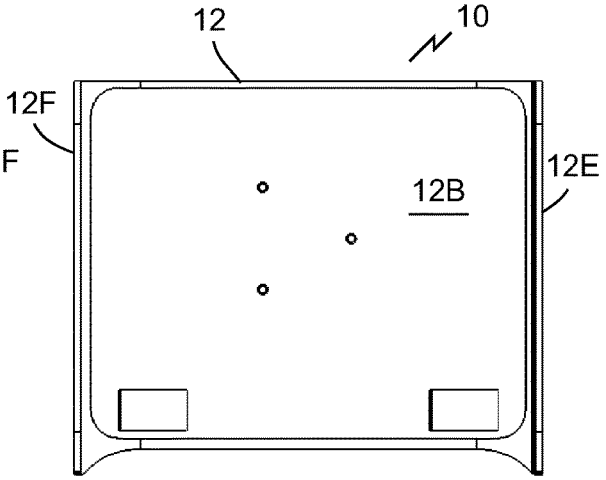
FIG. 36 is a rear elevation view of the bed ventilator if FIG. 33.
Figure 37:
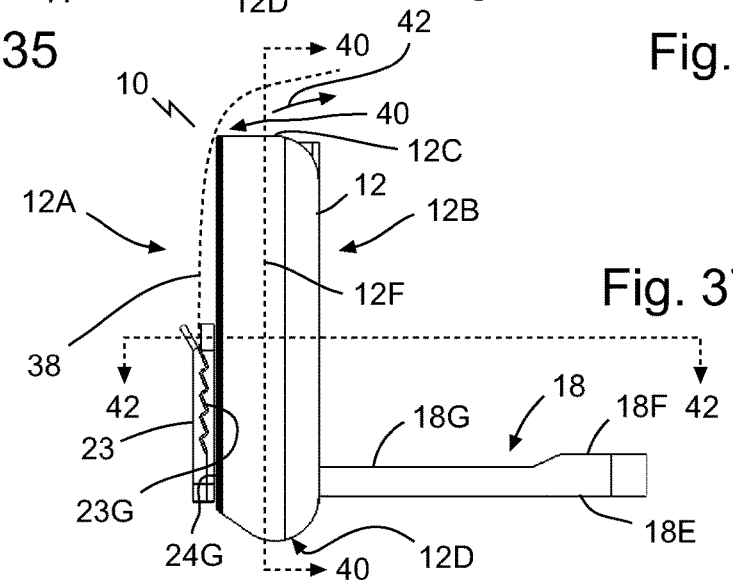
FIG. 37 is a side elevation view of the bed ventilator of FIG. 33.
Figure 38:
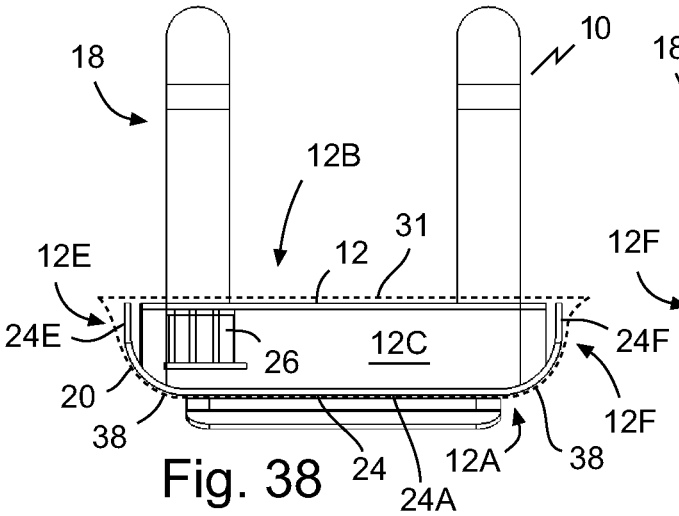
FIG. 38 is a top plan view the bed ventilator of FIG. 33.
Figure 39:
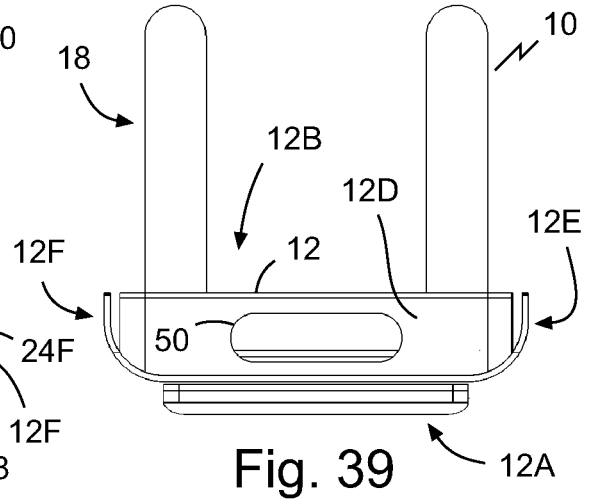
FIG. 39 is a bottom plan view the bed ventilator of FIG. 33.
Figure 40:
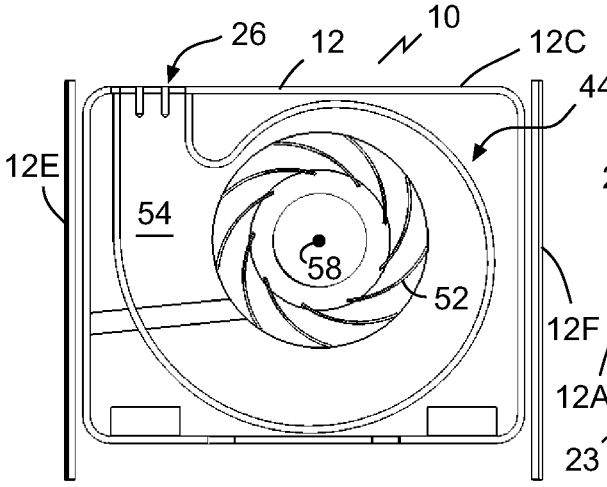
FIG. 40 is a section view taken along the 40-40 sections lines from FIG. 37.
Figure 41:
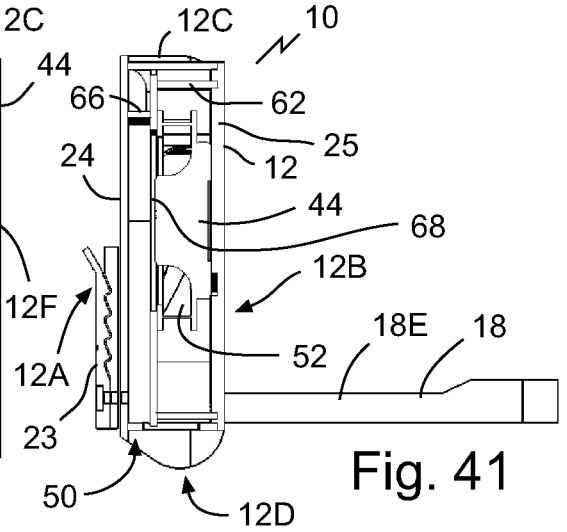
FIG. 41 is a section view taken along the 41-41 section lines from FIG. 35.
Figure 42:
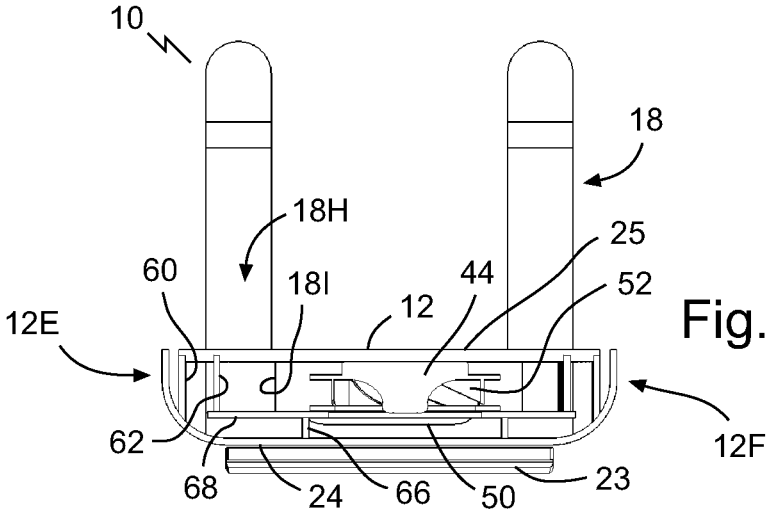
FIG. 42 is a section view taken along the 42-42 section lines from FIG. 37.
Figure 43:
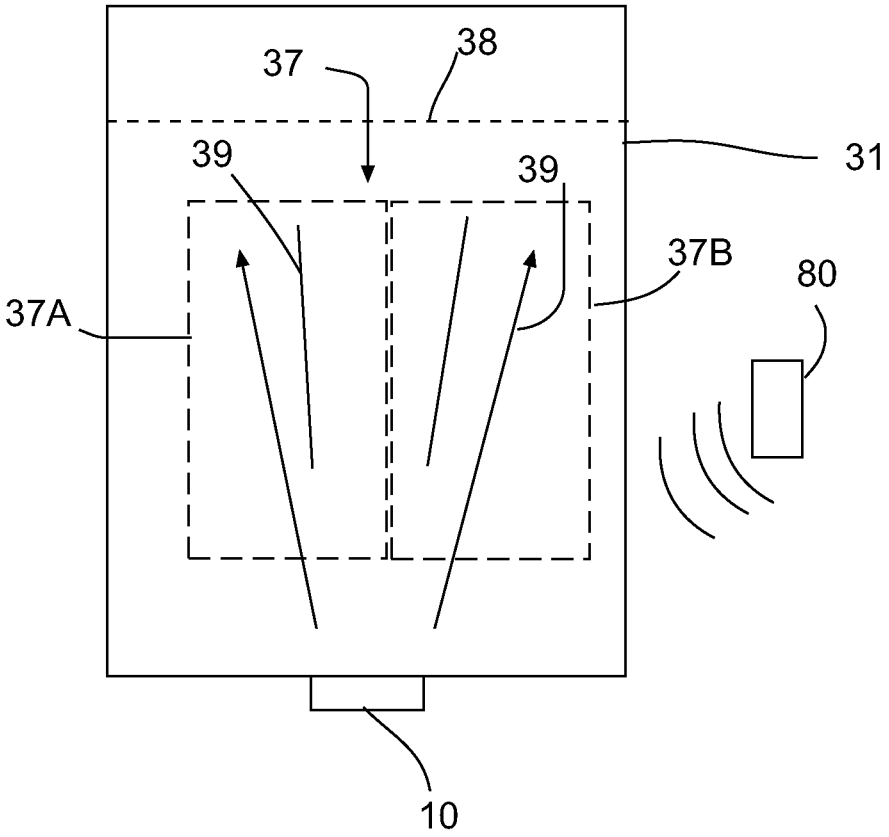
FIG. 43 is a top plan view of a bed with a bed ventilator installed.

Referring to FIGS. 23-42, two other embodiments are illustrated that show two different mechanisms of retaining bedding. Referring to FIGS. 23 and 27, a clip 23, for example a pair of clips 23, may be mounted on panel 24 to retain bedding 38. Each clip 23 may have top and bottom gripping parts 23A, B, which may permit bedding 38 (for example bedding 38A and bedding 38B respectively) to be mounted to either part. Referring to FIG. 25, fasteners 27 may mount clips 23 to panel 24. Referring to FIGS. 33, 34, and 38, sides or side walls 24E and 24F of panel 24 may be curved to follow the natural path of bedding 38 around housing 12 when under tension engaged by clips 23. Each clip may be resilient, hinged, or otherwise adapted to permit opening and closing by a user as desired.

Referring to FIGS. 24, 31, 33, and 34, a horizontal cantilever bar or bars 18E may be present to facilitate mounting of ventilator to a bed 31. The bars 18E may terminate with relatively thicker parts 18F extended from relatively thinner parts 18G. The beams or bars 18E may insert into mounting slots or holes 18H in the rear panel 25, passing through bar channels 18I within the housing 12. The bars 18E may be removable for example to permit mounting of different shaped bed mounts.

Referring to FIGS. 11-42, various methods of air intake may be used. The air inlet or intake 50 may be defined on one or more of the outer wall 12B, the side wall or walls 12E, F, and the base surface 12D of the ventilator. Referring to FIGS. 12 and 20-22, and FIGS. 34, and 40-42, the intake 50 may be defined through the base surface 12D. Drawing air through the base surface may avoid conflict or resistance from bedding or bedding 38. Referring to FIGS. 23-32, air intake 50 may draw from the base surface 12D and side walls 12E, F of the ventilator, for example to increase the areas from which air may be drawn in case of resistance from bedding 38 positioned over part of the air intake 50.

Referring to FIG. 44, an embodiment is illustrated with a ventilator attached to a bed 31. The ventilator expels air into the sleep zone or zone portions 37A, B. Plural ventilators may be present, for example one for each portion 37A, 37B. A sleep zone temperature sensor, such as sensor 39 which is positioned, for example mounted to or embedded within a bedding 38, detects the temperature of the sleep zone 37. Sensor 39 may be on top of the mattress, and may be a thread woven into the fabric, for example in the case of a graphene based threads, which may be stretchable, and waterproof, to provide a smart sheet. An IR sensor may have a suitable range such as six feet or longer to detect the temperature of an individual within the sleep zone. The temperature or other sensors may be mounted elsewhere in the room, such as on the individual, or outside the bed for example on the ceiling. A remote input terminal such as a mobile phone 80 may be used to send control signals to the controller in the ventilator. An application layer or other control software may be installed in a memory of the mobile phone, with the application layer configured to display an operational interface configured to send control signals to the controller. The ventilator may use signals from the various sensors to adjust operation. For example, when a sleep zone temperature, for example detected by an IR sensor, rises above a predetermined threshold, the air mover may be initiated or increased in power to increase air flow into the sleep zone. When the temperature lowers, the air flow may be reduced. The relative air flow may depend on the ambient temperature in the room.

In some cases a compact, discrete unit is provided that does not interfere with a user's access to a floor surface below the bed, and that does not restrict where a user may sit upon the bed. In some cases no hoses, diverters, or scoops are used. In some cases a quiet but effective system is provided. Bedding support 14 may be set at different heights depending on the preference of the user. A controllable diverter or plural diverter may be used for dual climate control, for example based on respective sets of user preferences. For example, one user may want air flow at a higher sensed temperature than the other, and the air mover may detect the respective temperature of each user, and adjust an output pressure of air flow toward the respective user by varying an opening on a diverter directed toward the respective user. The air mover may comprise one or more of a heater and an air sterilizer. Any suitable way of sterilizing the air may be used, for example using a UV ultraviolet bulb to sterilize the air. Air sterilization may be useful to reduce or eliminate toe fungus, or to protect patients with conditions that make such patients susceptible to infection, for example burn victims or other individuals with open wounds, or infections.

Part List

10—bed ventilator/bed cooler, 12—exterior housing, 12A,B—outer and bedside walls of exterior housing, 12C, D—top and base surfaces of exterior housing, 12E,F—side walls of exterior housing, 14—bedding support/sheet lifting bar, 14A—apertures to insert bar, 14B—column, 16—sensor housing, 16A—IR sensor, 16B—motion sensor, 16C—ambient air sensor, 18—bed mount/mattress mounting plate, 18A—mounting flange for mounting plate, 18B—slide retainer for mounting flange, 18C—hook part, 18D —horizontal cantilever plate, 18E—mounting bars, 18F—thick parts, 18G—thin parts, 18H—mounting slots or holes, 18I—bar-receiving channels, 20—side clips, 20A—pivot for side clips, 20B—clip arm, 20C—sheet receiving slot, 22—vertical sheet slot, 22A—base of slot, 23—front clips, 23A, B—top and bottom sheet-receiving portions of front clips, 23D—apertures, 24—front panel/lip, 24A—front wall of panel, 24E,F—side wall of panel, 24G—sheet gripping surface, 24H—hinge, 25—rear panel, 26—fan outlet/diverter, 26A—fan outlet grating, 27—fasteners, 30—air inlet grating, 31—bed, 32—top mattress, 34—lower mattress, 36—bed frame, 37—sleep zone, 37A/B—sleep zones or parts of sleep zone 37, 38—sheet, 39—in-bedding sleep zone temperature sensor, 40—bedding air flow conduit, 41—base surface of sleep zone, 42—direction of flow, 44—centrifugal fan, 46—power supply, 48—controller (computer), 50—impeller intake, 52 —backward facing impeller vanes or fan blades, 54—volute, 56—remote terminal, 58—axis of fan rotation, 60—perimeter housing wall, 62—volute wall, 64—volute front panel, 66—fan intake guide wall, 68—exterior panel, 68G—bedding gripping surface, 68H—extended part of panel 68, 68I—recessed part of panel 68, 70—magnets or fasteners, 72—apertures, 80—mobile phone.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. An apparatus comprising:

a bed with bedding;

an air mover, in which the air mover comprises a centrifugal fan with a volute and an impeller ring that has blades and is mounted to rotate within the volute, and the centrifugal fan is mounted such that an axis of fan rotation is perpendicular to a side, of the bed, that is against the air mover;

an air inlet defined by the air mover to direct air into the air mover;

an air outlet defined by the air mover to direct air into a sleep zone of the bed; and in which an exterior housing of the air mover has a base surface, a top surface, a first side wall, a second side wall, a bedside wall, and an outer wall opposite the bedside wall, with the air inlet located on one or more of the outer wall, the first side wall, the second side wall, and the base surface, and the air outlet located on the top surface of the air mover, which is below a plane defined by a base of a sleep zone of the bed, and being open in an upward direction to direct air into contact with bedding directly above the air mover in use to raise the bedding and form a bedding air conduit into the sleep zone of the bed.

2. The apparatus of claim 1 in which the centrifugal fan comprises a motor located within the impeller ring.

3. The apparatus of claim 1 in which:

the bedding air conduit extends up along a side of the bed;

the air mover is mounted to a side of the bed above a floor surface;

the air mover is mounted to the side of the bed via a bed mount that extends laterally between:

adjacent stacked mattresses; or between a mattress and a bed frame; and the bed mount comprises:

a horizontal cantilever plate or horizontal cantilever bar; or a part that hooks onto an upstanding wall of the bed frame.

4. The apparatus of claim 1 in which the air mover further comprises a bedding support that props up bedding above the air mover.

5. The apparatus of claim 1:

further comprising a controller connected to send control signals to the air mover; and further comprising one or more of a motion sensor and a temperature sensor, in which the controller is connected to send control signals to the air mover based on signals from the one or more of a motion sensor and a temperature sensor.

6. The apparatus of claim 5:

further comprising a motion sensor;

in which the controller is programmed to use signals from the motion sensor to:

detect a sleeping mode where a user is within the sleep zone between the bedding and the bed; and detect a non-sleeping mode where a user is on the bedding and outside the sleep zone; and in which the controller is programmed to:

when the sleeping mode is detected, maintain the air mover in, or initiate the air mover to enter, an operational mode; and when the non-sleeping mode is detected, maintain the air mover in, or initiate the air mover to enter, an off mode.

7. The apparatus of claim 5 further comprising a temperature sensor mounted to or forming part of the bedding.

8. The apparatus of claim 1 in which the exterior housing of the air mover comprises a bedding retainer.

9. The apparatus of claim 8 in which the bedding retainer comprises a bedding receiving slot.

10. The apparatus of claim 9 in which:

the bedding receiving slot extends the lateral length of the outer wall and opens in an upward direction; and an entrance of the bedding receiving slot is located above an air inlet defined by the air mover.

11. The apparatus of claim 1 in which the blades of the centrifugal fan comprise backward-facing blades.

12. The apparatus of claim 11 in which the centrifugal fan is mounted such that an axis of fan rotation is perpendicular to a side, of the bed, that is against the air mover.

13. The apparatus of claim 1 in which:

the exterior housing is formed of, in sequence:

a rear panel defining the bedside wall;

a curved volute wall forming the volute and defining the air outlet;

a volute front panel defining an opening;

a fan intake guide wall communicating with the air inlet and the opening; and a front panel defining the outer wall;

the centrifugal fan is mounted within the volute adjacent the opening in the volute front panel; and the exterior housing has a perimeter wall enclosing the space between the rear panel and the front panel.

14. A method comprising operating an air mover to direct air into a sleep zone defined between a bed and a bedding, in which the air mover comprises a centrifugal fan with a volute and an impeller ring that has blades and is mounted to rotate within the volute, and the centrifugal fan is mounted such that an axis of fan rotation is perpendicular to a side, of the bed, that is against the air mover, in which operating further comprises directing air from an air inlet, which is defined in one or more of an outer wall, a first side wall, and a second side wall of the air mover, through an air outlet, which is defined on a top surface of the air mover, which is below a plane defined by a base of a sleep zone of the bed, and opens in an upward direction, up into contact with bedding above the air mover to raise the bedding and form a bedding air conduit into the sleep zone of the bed.

15. The method of claim 14 further comprising propping up bedding above the air mover using a bedding support extended above the air mover.

16. The method of claim 14 further comprising:

detecting whether a user is present in the sleep zone; and maintaining the air mover in, or initiating the air mover to enter, an operating mode as long as the user is detected in the sleep zone.

17. The method of claim 14 further comprising:

detecting a temperature of a user present in the sleep zone using a temperature sensor; and maintaining the air mover in, or initiating the air mover to enter, an air-moving mode when the temperature of the user is above a predetermined threshold temperature.

18. The method of claim 14 further comprising:

detecting one or more of a sleep zone temperature and an ambient air temperature outside the bed using a sleep zone temperature sensor and an ambient air temperature sensor, respectively; and adjusting an air flow rate of the air mover based on the one or more of the sleep zone temperature and the ambient air temperature.

19. The method of claim 14 further comprising selecting an operating mode from a plurality of operating modes that include:

a high flow mode where the bedding in the sleep zone is lifted by air flow from the air mover to at least partially fill the bed; and a low flow mode where the air flow from the air mover follows the contour of a user's body without substantially lifting the bedding from the bed in the sleep zone.

* * * * *